US012486754B2

(12) United States Patent
Reinås

(10) Patent No.: US 12,486,754 B2
(45) Date of Patent: Dec. 2, 2025

(54) WELL ASSEMBLY MONITORING

(71) Applicant: Equinor Energy AS, Stavanger (NO)

(72) Inventor: Lorents Reinås, Stavanger (NO)

(73) Assignee: Equinor Energy AS, Stavanger (NO)

( * ) Notice: Subject to any disclaimer, the term of this patent is extended or adjusted under 35 U.S.C. 154(b) by 50 days.

(21) Appl. No.: 17/617,157

(22) PCT Filed: Jun. 8, 2020

(86) PCT No.: PCT/NO2020/050146
§ 371 (c)(1),
(2) Date: Dec. 7, 2021

(87) PCT Pub. No.: WO2020/246989
PCT Pub. Date: Dec. 10, 2020

(65) Prior Publication Data

US 2022/0259965 A1 Aug. 18, 2022

(30) Foreign Application Priority Data

Jun. 7, 2019 (GB) ..... 1908160

(51) Int. Cl.
*E21B 44/00* (2006.01)
*E21B 33/035* (2006.01)
(Continued)

(52) U.S. Cl.
CPC ..... *E21B 44/00* (2013.01); *E21B 47/001* (2020.05); *E21B 47/005* (2020.05); *E21B 47/08* (2013.01); *E21B 33/035* (2013.01)

(58) Field of Classification Search
CPC ..... E21B 47/08; E21B 33/035; E21B 41/08; E21B 47/01; E21B 7/043; E21B 15/02; E21B 47/00
See application file for complete search history.

(56) References Cited

U.S. PATENT DOCUMENTS 5,363,094 A 11/1994 Staron et al.
2002/0029908 A1* 3/2002 Bloom ..... E21B 4/18 166/212

(Continued)

FOREIGN PATENT DOCUMENTS

GB 2386623 A * 9/2003 ..... E21B 19/143
WO 2016010517 A1 1/2016

OTHER PUBLICATIONS

Aug. 13, 2020—(WO) International Search Report and Written Opinion—App PCT/NO2020/050146.
Dec. 6, 2019—(GB) Combined Search and Exam Report—App 1908160.3.

*Primary Examiner* — Yanick A Akaragwe
(74) *Attorney, Agent, or Firm* — Banner & Witcoff, Ltd.

(57) ABSTRACT

Herein disclosed is a well assembly comprising a sensor and a method of monitoring using the sensor. The well assembly may comprise a wellbore and the sensor, wherein the sensor is in a fixed location relative to the wellbore, and wherein the sensor is for monitoring the size and/or shape of the wellbore. The method may be a method of monitoring the size and/or shape of the wellbore. The method may comprise: providing the sensor in a fixed location relative to the wellbore, and monitoring the size and/or shape of the wellbore using the sensor. The well assembly may comprise a well foundation and the sensor, wherein the sensor is in a fixed location relative to the well foundation, and wherein the sensor is for monitoring the earth underneath the well foundation during installation of the well assembly. The method may be a method of monitoring the earth underneath the well foundation. The method may comprise providing the sensor in a fixed location relative to the well foundation, and monitoring the earth underneath the well foundation during installation of the well assembly.

19 Claims, 3 Drawing Sheets

(51) Int. Cl.
*E21B 47/001* (2012.01)
*E21B 47/005* (2012.01)
*E21B 47/08* (2012.01)

(56) References Cited

U.S. PATENT DOCUMENTS

| | | | | |
|---|---|---|---|---|
| 2004/0020691 | A1 | 2/2004 | Krueger | |
| 2010/0223988 | A1 | 9/2010 | Crow et al. | |
| 2011/0297390 | A1* | 12/2011 | Kocaman | E21B 33/134 166/360 |
| 2012/0024050 | A1 | 2/2012 | Godager | |
| 2014/0214325 | A1* | 7/2014 | Wessling | E21B 47/06 702/11 |
| 2015/0299974 | A1* | 10/2015 | Younan | E21B 33/037 405/9 |
| 2015/0300150 | A1 | 10/2015 | Burkay | |
| 2016/0237803 | A1 | 8/2016 | Patel | |
| 2016/0298393 | A1* | 10/2016 | Molaschi | E21B 17/01 |
| 2017/0199295 | A1* | 7/2017 | Mandal | E21B 33/14 |
| 2017/0328161 | A1* | 11/2017 | Ellingsen | E21B 19/002 |
| 2017/0356265 | A1* | 12/2017 | Strand | E21B 33/043 |
| 2018/0094519 | A1* | 4/2018 | Stephens | E21B 47/007 |
| 2018/0171574 | A1* | 6/2018 | Strand | B63B 21/27 |
| 2018/0283162 | A1 | 10/2018 | Bird et al. | |
| 2018/0347140 | A1* | 12/2018 | Mathis | E02D 27/18 |

* cited by examiner

WELL ASSEMBLY MONITORING

The present application claims priority from and is a U.S. National Phase of International Application No. PCT/NO2020/050146, which was filed on Jun. 8, 2020, designating the United States of America and claiming priority to United Kingdom Patent Application No. 1908160.3, filed on Jun. 7, 2019. This application claims priority to and the benefit of the above-identified applications, which are all fully incorporated by reference herein in their entireties.

The invention relates to a well assembly comprising a sensor for monitoring a wellbore of the well assembly, the earth underneath the well assembly and/or during installation of the well assembly. The invention also relates to a method of monitoring a wellbore using a sensor, the earth underneath the well assembly using a sensor, and/or monitoring using a sensor during installation. The present invention may in particular relate to a subsea well assembly and/or methods that are performed subsea.

Currently when installing and/or drilling well assemblies, problems in and around the wellbore and underneath the well foundation, such as washout, can occur. This can have significant negative impacts on the well assembly and, in severe cases, can even result in the well having to be abandoned. Thus, there is a need for systems and methods that may be able to address these problems.

In a broadest aspect the present invention may provide a sensor for monitoring the earth, well assembly and/or a wellbore during one or more well life phases. The well life phases may include: installation, drilling, construction, use (including production and/or injection), intervention (i.e. maintenance) and/or cessation (i.e. removal).

The present invention may provide a sensor for monitoring the earth, well assembly and/or a wellbore during installation and/or removal of a well assembly and/or during drilling of the wellbore.

The invention may provide a method of using a sensor to monitor the earth, well assembly and/or a wellbore during one or more well life phases. The well life phases may include: installation, drilling, construction, use (including production and/or injection), intervention (i.e. maintenance) and cessation (i.e. removal).

The invention may provide a method of using a sensor to monitor the earth, well assembly and/or a wellbore during installation and/or removal of a well assembly and/or during drilling of the wellbore.

In a first aspect the present invention provides a subsea well assembly, the subsea well assembly comprising: a wellbore; and a sensor, wherein the sensor is in a fixed location relative to the wellbore, and wherein the sensor is for monitoring the size and/or shape (i.e. geometry) of the wellbore.

In a second aspect the present invention provides a method of monitoring the size and/or shape of a wellbore of a subsea well assembly, the method comprising: providing a sensor in a fixed location relative to the wellbore, and monitoring the size and/or shape of the wellbore using the sensor.

In a third aspect, the present invention provides a subsea well assembly, the subsea well assembly comprising: a well foundation; and a sensor, wherein the sensor is in a fixed location relative to the well foundation, and wherein the sensor is for monitoring the subsea assembly during installation of the subsea well assembly and/or for monitoring the earth underneath the well foundation during installation of the subsea well assembly.

In a fourth aspect the present invention provides a method of monitoring a subsea assembly and/or the earth underneath a well foundation of the subsea assembly, the method comprising: providing the sensor in a fixed location relative to the well foundation, and monitoring the subsea assembly during installation of the well assembly and/or monitoring the earth underneath the well foundation during installation of the well assembly.

Whilst the invention is disclosed herein in relation to subsea well assemblies (i.e. underwater well assemblies such as on the seabed or bed of a lake etc), it should be appreciated that the invention could equally be used in non-subsea locations.

The invention may comprise using the apparatus, i.e. sensor, to monitor the size and/or shape of the wellbore, to monitor the well assembly itself and/or to monitor the earth underneath the well foundation.

By having a sensor monitoring the shape and/or size of the wellbore that is in a fixed location relative to the wellbore and/or by having a sensor that is fixed relative to a well foundation for monitoring the well assembly and/or earth underneath the foundation, problems in and around the wellbore, in the well assembly and underneath the well foundation may be detected. If problems in and around the wellbore and/or in the well assembly are detected, appropriate remedial measures may be taken. This may be during one or more well life phases.

The sensor may be for monitoring the well assembly and/or the earth underneath the well foundation during installation of the subsea well assembly.

Installation of the well assembly may comprise installation of the well foundation, wellbore drilling and casing installation and/or cementing etc.

The sensor may be for monitoring the well assembly and/or the earth underneath the well assembly during one or more or all of the stages of installation of the well assembly.

The sensor may be for, and/or the method may comprise, monitoring the geometry of the wellbore.

The sensor may be for, and/or the method may comprise, monitoring the wellbore, well assembly and/or earth underneath the well foundation during drilling, forming, casing and/or cementing of the wellbore. The sensor may be for, and/or the method may comprise, monitoring the wellbore, well assembly and/or earth underneath the well foundation during installation of the well assembly.

The sensor may be for, and/or the method may comprise, monitoring the earth, e.g. wellbore, beneath the surface, e.g. waterbed such as the seabed.

The surface may be the surface on which the well assembly is installed. For example, in a subsea well assembly, the surface may be the surface of the seabed.

The sensor may be for, and/or the method may comprise, monitoring the structural integrity of the earth underneath the components of the well assembly at the surface (e.g. the well foundation).

The sensor may be for, and/or the method may comprise, monitoring the earth and wellbore under the well foundation so as to allow assessment of the earth that supports and/or is for supporting the foundation.

The sensor may be for monitoring cementing operations during installation of the subsea well assembly.

The sensor (e.g. a sensor attached to the well foundation) may be for confirming that a desired level of cement has been achieved during and/or following a cementing operation, i.e. during installation of the subsea well assembly. The method may be for monitoring cement during installation of the subsea well assembly.

The sensor may in use be embedded in the earth. Thus the method may comprise embedding the sensor in the earth underneath or near a well assembly/well foundation.

The sensor may not be for, and/or the method may not comprise, monitoring the surface of the earth, e.g. the seabed, but instead may be for monitoring features, such as the wellbore, underneath the surface on which the well assembly is installed, e.g. the seabed.

The sensor may be for, and/or the method may comprise, monitoring the earth underneath the sensor (e.g. in a vertically downward direction) and/or obliquely to the sensor.

The sensor may be for, and/or the method may comprise, monitoring an uppermost part of the wellbore, e.g. within 50 m of the surface. The sensor may be for, and/or the method may comprise, monitoring a fixed portion of the wellbore.

The surface referred to herein may be the surface on which the well assembly is installed, e.g. the seabed.

The sensor may be for, and/or the method may comprise, monitoring a portion of the earth and/or wellbore the structural integrity of which has an effect on the structural integrity of the well assembly, e.g. well foundation.

The sensor may be for, and/or the method may comprise, detecting structural defects that could affect the structural integrity of the well foundation, i.e. that could affect the ability of the foundation to effectively support other components of the well assembly, e.g. the wellhead.

The portion of the wellbore that is monitored may be the portion immediately underneath and/or in close proximity to the surface. This is because, the integrity of this portion of the wellbore may affect the components at the top of the wellbore at the surface, e.g. at the seabed. As a result, monitoring the structural integrity of this portion of the wellbore may be most important to the integrity and safety of the well assembly, including the components at the top of the wellbore.

The sensor may be for, and/or the method may comprise, monitoring the shape and/or size of a wellbore during the drilling of the wellbore. In this case the sensor may in a fixed location relative to the wellbore. For example, the sensor may be mounted on and/or fixed to a component of the well assembly, such as the well foundation. The component to which the sensor is mounted and/or fixed may be a component that once installed is stationary, i.e. in a fixed location relative to the earth.

The sensor may be provided on the well foundation. The well foundation may be a suction anchor. The sensor may be provided at a location on the foundation where in use it is embedded in the earth, e.g. in the seabed. For example, in the case of a suction anchor, this may be (at or towards) the lowermost end of the suction anchor (this may be referred to as the bottom of the suction anchor despite the fact the suction anchor has an open bottom.

In the case that the foundation is a suction anchor, the sensor may be provided on the outer suction skirt, the underside of the top of the suction anchor, a tube through which drilling occurs, and/or any position within the suction skirt, such as on internal supports/stiffeners. The sensor may be for, and/or the method may comprise, monitoring the size and/or shape of a wellbore drilled through a well tube of the suction anchor. The well tube through which the wellbore is drilled may be through the suction anchor (e.g. through the centre or at an eccentric location) or on an outside of the suction anchor (such as directly on the outside or in close proximity thereto). The sensor may be provided inside, outside or below the suction anchor volume in any way.

The sensor may be for, and/or the method may comprise, monitoring the earth underneath the well foundation. This may be during installation of the well assembly and/or during drilling of the wellbore. In this case, the sensor may be mounted on and/or fixed to the well foundation.

The sensor may be installed together with the well foundation.

The sensor may be used to detect changes in the wellbore shape. The sensor may be used for example to detect changes in the shape of the wellbore that occur due to washout and/or swell of the wellbore for example.

The sensor may be for, and/or the method may comprise, detecting structural defects, such as washout, underneath a well assembly, e.g. at the wellbore.

The sensor may be used to provide information about wellbore stability.

Currently problems, such as washout and/or swell, can be predicted, e.g. based on factors such as knowledge of the earth geology. However, such predictions may be quite conservative and the present invention may allow more accurate assessments to be made. This may allow the avoidance of performing remedial measures in cases where the problem has not and/or will not occur.

The assembly and method may allow identification of the onset of problems, such as washout. For example, onset of washout may be indicated by a change to the boreholes size during subsequent processes, such as pumping of drilling fluids. This may allow for implementation of precautionary/remedial measures (e.g reduction in pumping rate during drilling), during installation and/or drilling due to early detection of e.g. washout.

Typically washout is a progressive event and may only cause issues once it has occurred to a certain extent. Thus, by monitoring for washout, remedial measures can be taken before washout has occurred to an extent that causes issues for the subsea well assembly.

The data from the sensor may be used to improve future predictions of potential problems, particularly in installations where a sensor is not present. This may be achieved by the sensors being used to provide data regarding the behaviour of certain geologies under certain conditions such that more accurate future predications can be made about when problems may arise when similar geologies and conditions are encountered.

If a defect is detected and/or a change occurs (e.g. a change in the wellbore size or shape that suggests a defect, such as washout, will occur or has started to occur), remedial measures, such as casing and/or cementing or reduced pumping rate, may be performed to prevent problems such as significant washout occurring.

The apparatus may be for, and the method may comprise, monitoring for onset of washout (before any significant problems, such as loss of foundation/support, occur) such that remedial measures can be taken, such as suspending the drilling operation and/or altering the drilling parameters, such that a further washout may be prevented.

The sensor may be for, and/or the method may comprise, identifying hazards during installation of the well assembly, such as during installation of the foundation and/or the initial drilling of a wellbore (i.e. before casing installation), such that preventive measures may be taken to prevent issues. The preventative measures may for example involve identifying a different location for installation of the well assembly (e.g. one that is free of, or less risk or prevalence of hazards), adjusting drilling parameters and/or drilling in a different direction etc.

The hazard identified may comprise one or more of obstructions (e.g. boulders) that may impede or compromise the installation of the well foundation, shallow gas (that may impede or compromise drilling), and/or gas hydrates (such as methane hydrate) that may impede or compromise drilling. Thus the sensor may be for monitoring for hazards such as obstructions, shallow gas, and/or gas hydrates etc.

The sensor may be for, and/or the method may comprise, monitoring the earth underneath the foundation before, during and after installation of the well foundation.

The sensor may be for, and/or the method may comprise, monitoring the earth underneath the well foundation before and/or during installation of the well foundation and/or during drilling. This may for example allow it to be checked that the installation location is suitable. For example, the sensor may be used to check for obstructions or hazards, such as boulders, or defects that may hinder installation of the foundation and/or compromise the effectiveness or integrity of the foundation or assembly once installed, and/or may impede or comprise drilling operations.

If the sensor is used to monitor the wellbore during drilling, the sensor may be located proximal (e.g. within 50 m) of the wellbore being drilled. The sensor may be arranged so that it senses information concerning the wellbore shape.

The sensor may have a range up to 50 m, 100 m, 200 m, 1000 m, or more. Therefore, the sensor may be within 50 m of the part of the earth being monitored.

The sensor may be directed down into the ground in which the drilling is performed.

The sensor may comprise one or more sensing devices. Thus the sensor may comprise a plurality of sensing devices that are each for monitoring a different part of the earth. For example, different sections of the wellbore may be monitored. The data from a plurality of sensing devices may be combined to provide information about a larger area of the earth being monitored.

The sensor may additionally or alternatively comprise a plurality of sensing devices that are each for monitoring the same or different properties. For example, different properties may be monitored.

The well assembly may comprise a plurality of sensors.

The assembly comprising a plurality of sensors or sensing devices may allow more information to be ascertained about the well assembly and/or the surrounding environment (by monitoring a larger area and/or more properties).

In the case that a plurality of sensors or sensing devices are provided, one of the plurality of sensors/sensing devices may be for monitoring the borehole, one of the plurality of sensors/sensing devices may be for monitoring the earth underneath the well foundation and/or one of the plurality of sensors/sensing devices may be for monitoring the well assembly itself (e.g. cement level).

The plurality of sensing devices or sensors (if present) may be provided at a plurality of different locations relative to the well bore and/or relative to the foundation.

Having sensing devices or sensors at a plurality of locations may for example allow full monitoring coverage of the wellbore from top to bottom. The sensor or sensing device at a lowermost location may monitor a region in a downward location from the sensor or sensing device (e.g. for monitoring hazards, such as boulders, shallow gas or gas hydrates, underneath the well foundation).

The assembly comprising a plurality of sensors or sensing devices may provide redundancy in the case that one or more of the sensors or sensing devices fails.

The sensor, e.g. one or more sensing devices, may provide data to a processor. The processor (e.g. a computer) may process the data and output information. This information may be used to assess whether any changes are required in the operation, e.g. whether any remedial measures need to be taken.

The sensor may comprise a computer/processor for processing the measured data.

The sensor may comprise a communication link interface for relying of data and/or processed output to users, e.g. above the sea.

The sensor may comprise a power source, such as a battery, for powering the sensor.

The sensor may comprise a memory for storing measured data and/or processed output.

The sensor may be in a buried location, i.e. under the surface of the earth, e.g. seabed.

The sensor may be a stationary sensor, i.e. a sensor that is in a fixed location.

The sensor may for example, not be on the drill string.

The sensor is in a fixed position during use, i.e. stationary.

The sensor may be permanent, e.g. left after the assembly is installed and/or drilling of the wellbore is finished. Thus the sensor may additionally be capable of, and/or used to, monitor the earth under a wellhead during operation of the well, e.g. during injection and/or production. Thus, the sensor may permit permanent survey underneath a well foundation for example.

The sensor may be used to monitor during uninstallation (e.g. during a plug and abandonment operation) of a well assembly.

Alternatively the sensor may be temporary, e.g. removed after the assembly is installed and/or drilling has finished (e.g. when the chance of structural defects occurring is far less).

The sensor may be arranged so that it can be removed from the fixed position after use, e.g. after installation of the well assembly.

The sensor may be retrievable from the fixed position. For example, the sensor may be retrieved and replaced if it has failed and/or a component needs replacing such as a battery.

The sensor may be fully autonomous. This may mean that it can operate without connection or communication to external equipment, e.g. equipment which may be above the water. The sensor and/or part of the sensor, may be retrieved in order to obtain the data stored therein.

The sensor may be for, and/or the method may comprise, monitoring wellbore dimensions.

The sensor together with suitable processing software may effectively image the wellbore. Thus the sensor may provide an image of the earth underneath a well foundation and/or of a wellbore.

Thus the sensor may be for, and/or the method may comprise, producing imagery of the wellbore. The image may be updated over time.

The sensor may additionally be for, and/or the method may comprise, monitoring water levels in the earth.

The sensor may provide continuous monitoring, intermittent monitoring and/or responsive monitoring (e.g. upon request). The method may comprise continuously monitoring, monitoring at certain time intervals, and/or monitoring upon request.

The sensor may be an acoustic, ultrasonic and/or electromagnetic sensor. For example the sensor may be a radar sensor such as a near field radar sensor.

The sensor may be for monitoring dimensions, density changes, pH levels. The sensor may be or comprise an imaging device.

The sensor may be or comprise a 4D calliper for generation of 4D images.

The sensor may comprise nanoscale impulse radar sensing devices.

The sensor may comprise one or more transmitters, receivers and/or transceivers.

The sensor may comprise one or more transmitters for receiving signals emitted from a remote location.

The sensor may provide distance measurements. For example, the sensor (which may comprise one or more sensing devices) may provide information about the distance from the sensor (e.g. from the particular sensing device) to one or more boundaries. These boundaries may for example be changes in the geology e.g. the edges of the wellbore, when density and/or water content changes. The sensor may provide such distance measurements using attenuation, impedance and/or reflection of signals etc.

The sensor may be for, and/or the method may comprise, measuring the inner diameter of the wellbore.

The sensor (and associated processor) may be for, and/or the method may comprise, monitoring the earth, e.g. the wellbore, over time and comparing the detected information, e.g. size and/or shape of the wellbore at a given location, at a given time to the detected information, e.g. size and/or shape of the wellbore at that location, at a different time.

The sensor may be connected to the foundation of the well. The sensor may be installed together with the foundation of the well.

The well foundation may be installed before drilling of the wellbore begins.

The foundation may be a suction anchor.

The sensor (i.e. one or more sensing devices) may be located at or near the bottom of the foundation, i.e. the part of the well foundation that in use is embedded in the ground. This may for example, in the case of the foundation being a suction anchor, be at or near the bottom of the suction skirt and/or at or near the bottom of a well tube of the suction anchor through which a well may be drilled (this may be a central tube, an eccentric tube, or a tube external of the suction volume).

When the sensor is provided on a well foundation, the sensor may be used to help identify a suitable location for the foundation to be installed. This is because it can be used to avoid the foundation being installed in a location where there is a hazard such as a boulder, or some other obstruction or shallow gas or gas hydrates etc., that may prevent or hinder the installation of the foundation and/or potentially compromise later integrity of the foundation or compromise later operations such as drilling.

When the sensor is provided on a suction anchor, the sensor may be used to help identify a suitable location for the suction anchor to be sucked into the ground. This is because it can be used to avoid the suction anchor being sucked into the ground in a location where there is a hazard such as a boulder, or some other obstruction or shallow gas or gas hydrates etc., that may prevent or hinder the penetration of the suction anchor into the seabed and/or potentially compromise later operations such as drilling.

Operations may be adjusted based on the output from the sensor. For example, if the sensor detects a change in the size and/or shape of the wellbore, remedial measures, such as cementing, casing and/or adjusting of drilling parameters, may be performed. This may, for example, be to limit or prevent a defect, such as washout, occurring. Early detection of changes in the earth underneath the well assembly, e.g. changes in the size and/or shape of the wellbore, may allow defects, such as washout or swell, that could negatively impact the well assembly, to be prevented. For example, by allowing onset of washout to be detected, progression of the washout may be avoided so as to avoid washout occurring to extent that it compromises the well assembly.

The sensor may be used to detect structural defects, such as cavitation, washout, swell etc., which could affect the well components at the surface of the earth.

The method may comprise monitoring for and/or detecting cavitation (or other structural defects) that may affect the well components at the surface of the earth.

The well assembly may be a well assembly during installation and/or drilling. Thus, for example, the well assembly may be the assembly before all parts of an operating well assembly are installed, e.g. before the wellhead is installed.

The well may be an oil and/or gas well, a water and/or gas injection well, a $CO_2$ disposal well, and/or a gas hydrate production well.

The well and well assembly may be a subsea well and subsea well assembly. The earth may be the seabed and the surface of the earth where the well components are installed may be the surface of the seabed.

The wellbore may be referred to as a borehole. The wellbore may be the borehole of a well.

The method of the invention may comprise using the apparatus of the invention.

A preferred embodiment of the present invention will now be described by way of example only with reference to the accompanying drawing, in which.

Figure 1:
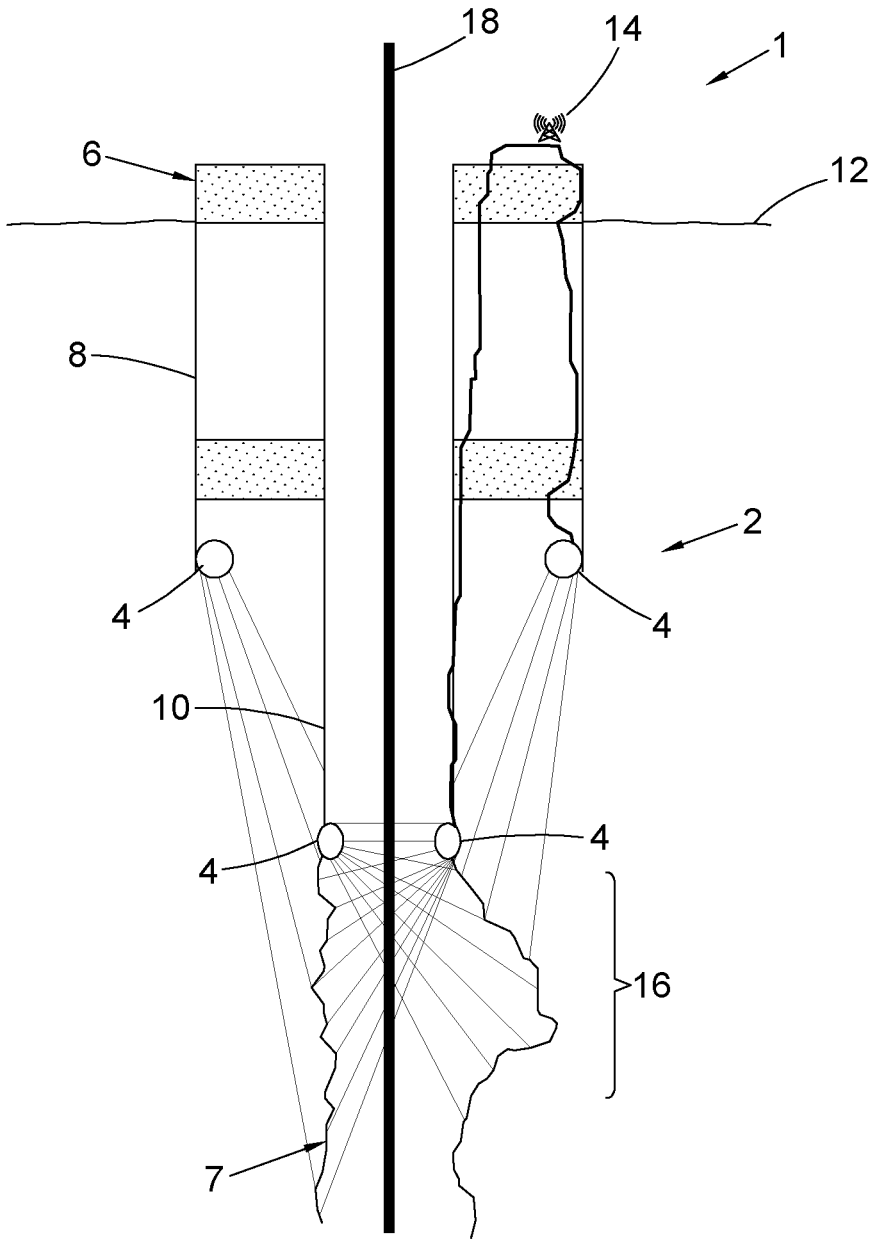
FIG. 1 shows a well assembly comprising a sensor.

Considering first FIG. 1, the well assembly 1 comprises a sensor 2 that comprises a plurality of sensing devices 4. The sensing devices 4 are mounted to a well foundation 6 (which in this illustrated embodiment is a suction anchor). The sensing devices 4 are arranged to monitor the earth underneath the foundation 6, including the wellbore 7.

Whilst in this embodiment the sensing devices 4 are shown mounted at the bottom of the outer suction skirt 8 of the suction anchor 6 and at the bottom of the central tube 10 of the suction anchor 6, the sensing devices 4 may be located in any location that is fixed relative to the foundation 6 and/or the wellbore 7.

The sensing devices 4 are embedded in the seabed 12 and are arranged to monitor the earth underneath the well foundation 6, including the wellbore 7.

The sensing devices 4 are connected (in this case via wires though the connection may be by any means such as wireless connection) to a processor 14. The processor 14 may be on the foundation 6 as shown, or part of the sensor 2 or provided at a remote location (such as above the surface of the sea).

The sensor 2 may monitor the earth underneath the foundation 6 over time. The data sensed by the sensor 2 may be sent to the processor 14 where the data can be processed and used to determine if there are any defects in earth underneath the well foundation 6 that may affect the structural integrity of the well and foundation 6 etc. Data from the sensor 2 (processed or unprocessed) may be transferred to a remote location, such as a drilling unit.

The sensing devices 4 may provide information on the size and/or shape of the wellbore 7 over time. This may be used to detect defects forming such as washout 16. The sensing devices 4 may provide information during drilling of the wellbore 7. This may for example be by using a drill string 18 that drills the wellbore 7 through the well foundation 6.

The sensing devices 4 may be provided on the well foundation 6 prior to installation of the well foundation 6.

Figure 2:
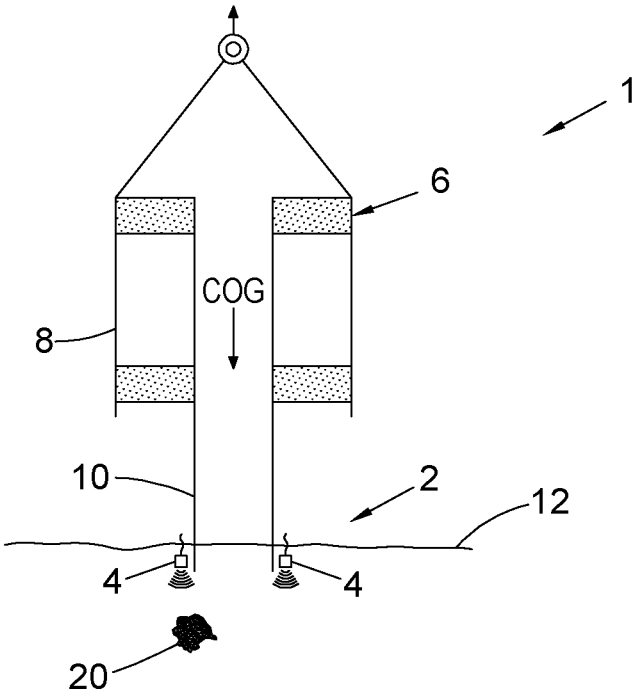
FIGS. 2, 3, 4 and 5 show the installation of a well assembly comprising a sensor.
Figure 3:
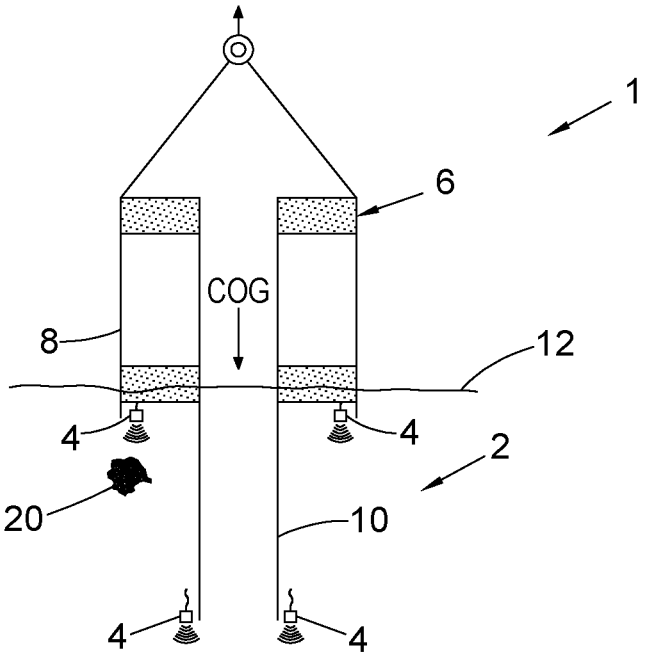
Figure 4:
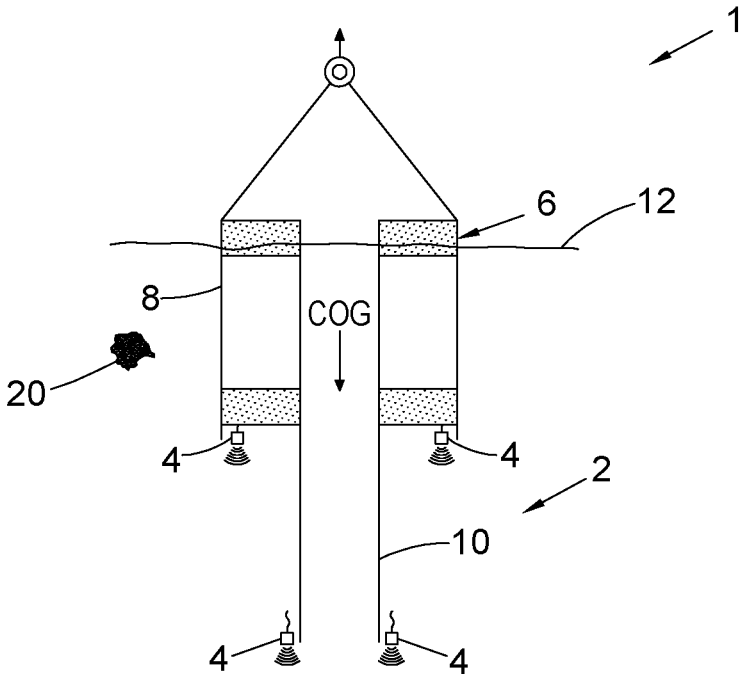

Thus, the sensing devices 4 may be used to monitor the earth underneath the foundation 6 before it is fixed to the seabed 12 as illustrated for example with FIGS. 2, 3 and 4. Thus, the sensor 2 may be used to help identify a suitable location on the seabed 12 for the foundation 6 to be installed.

In the case that the foundation 6 is a suction anchor, it will be sucked into the seabed 12. The sensor 2 may be used to survey the earth underneath the surface of the seabed before the foundation is sucked into the seabed so as to allow a suitable location for the suction anchor 6 to be sucked into the seabed 12 to be identified. This may for example be a location that is free of significant hazards 20, such as boulders (which may impede installation of the foundation), shallow gas or gas hydrates etc (which may compromise later drilling operations).

As shown in FIG. 2, the sensor 2, and in particular sensing devices 4 attached to the bottom of the central tube 10, may be used to identify a hazard before the suction skirt 8 even reaches the seabed 12. The sensor 2 may be used to identify hazards that would be encountered by the central tube 10 as the foundation 6 is installed. If such a hazard 20 is identified, the foundation 6 may be installed in a different location such that the foundation does not encounter the hazard 20 as it is installed into the seabed as illustrated in FIG. 4.

As illustrated by FIG. 3, the assembly 1 may also comprise sensing devices 4 at the bottom of the suction anchor 6 itself. These sensing devices 4 may for example be attached to internal stiffeners within the suction anchor 6. These sensing devices 4 may be used to identify hazards 20 that the suction skirt 8 would encounter if the suction anchor 6 were fully sucked into the seabed. If such hazards 20 are identified, the foundation 6 may be installed in a different location such that the foundation does not encounter the hazard 20 as it is installed into the seabed as illustrated in FIG. 4.

Figure 5:
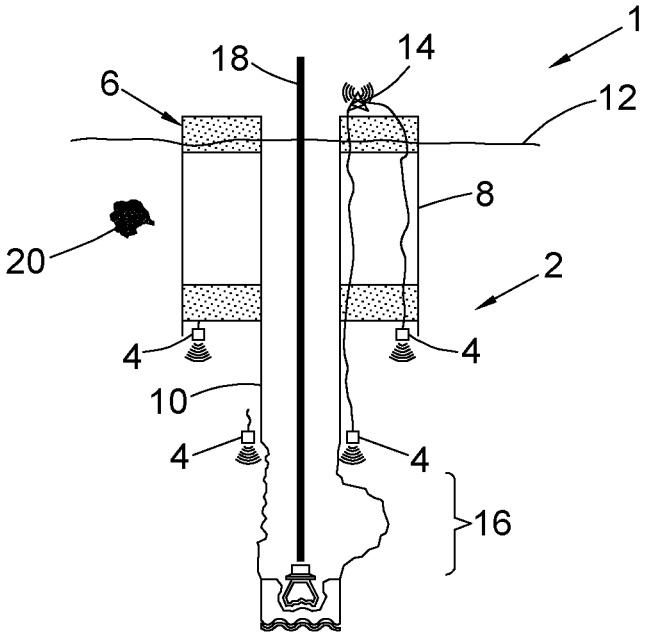

As illustrated by FIG. 5, the sensor 2 may alternatively or additionally be used to monitor the earth underneath the foundation 6 after it has been fixed to the seabed 12. This may be during drilling, for example, when the risk of defects such as washout may be highest.

If defects are detected, or there is a change in the earth that suggests that a defect may occur, appropriate remedial measures may be taken. The remedial measures may prevent the defect developing further and/or causing any significant issue to the well components above the defect. The remedial measures may include casing, cementing and/or adjusting drilling parameters (such as drilling mud pumping rate) etc.

The sensor 2 may alternatively or additionally be used to monitor the well assembly 1 itself during installation. This may be during cementing, for example, when it would be beneficial to check that cement is provided to the desired locations.

Thus, the sensor 2 may be used to monitor the installation of the well assembly 1. This is so that it can be checked that installation has occurred as desired.

The invention claimed is:

1. A subsea well assembly, the subsea well assembly comprising:
- a well foundation fixed to the seabed and defining a wellbore location prior to drilling a wellbore; and
- a sensor fixed to the well foundation before drilling of the wellbore and casing installation, and
- wherein the sensor is for monitoring the size and/or shape of the wellbore during initial drilling of the wellbore before casing installation, and
- the sensor is for monitoring the earth underneath the sensor and/or obliquely to the sensor.

2. The subsea well assembly according to claim 1, wherein the well foundation is a suction anchor.

3. The subsea well assembly according to claim 1, wherein the sensor is for monitoring the size and/or shape of a borehole drilled through the foundation.

4. The subsea well assembly according to claim 1, wherein the sensor is for detecting structural defects that could affect the structural integrity of the subsea well assembly.

5. A method of monitoring the size and/or shape of a wellbore of a subsea well assembly, the method comprising:
- providing a subsea well assembly comprising:
  - a well foundation fixed to the seabed and defining a wellbore location prior to drilling a wellbore; and
  - a sensor fixed to the well foundation before drilling the well bore and casing installation; and
- monitoring the size and/or shape of the wellbore during initial drilling of the wellbore before casing installation using the sensor,
- wherein the sensor is for monitoring the earth underneath the sensor and/or obliquely to the sensor.

6. The method according to claim 5, wherein the well foundation is a suction anchor.

7. The method according to claim 5, wherein the method comprises monitoring the size and/or shape of a borehole drilled through the foundation.

8. The method according to claim 5, wherein the method comprises detecting structural defects that could affect the structural integrity of the well assembly using the sensor.

9. The method according to claim 5, wherein the method comprises detecting a change in the size and/or shape of the wellbore, and taking remedial measures to avoid or minimize further change in the size and/or shape of the wellbore.

10. A subsea well assembly, the subsea well assembly comprising:
- a well foundation configured to be fixed to the seabed and to define a wellbore location; and
- a sensor fixed to the well foundation before drilling of the wellbore and casing installation; and
- wherein the sensor is for monitoring earth underneath the well foundation before and/or during installation of the well foundation for identifying a suitable location for the well foundation to be installed.

11. The subsea well assembly according to claim 10, wherein the sensor is for monitoring the earth underneath the foundation during drilling.

12. The subsea well assembly according to claim 10, wherein the well foundation is a suction anchor.

13. The subsea well assembly according to claim 10, wherein the sensor is for detecting structural defects that could affect the structural integrity of the well foundation.

14. The subsea well assembly according to claim 10, wherein the sensor is for monitoring cement during installation of the subsea assembly.

15. A method of monitoring the earth underneath a well foundation of a subsea well assembly, the method comprising:
- providing a well foundation configured to be fixed to the seabed and to define a wellbore location prior to drilling a wellbore;
- providing a sensor fixed to the well foundation before drilling of the wellbore and casing installation;
- monitoring the earth underneath the well foundation using the sensor before and/or during installation of the well foundation; and
- identifying a suitable location for the well foundation to be installed using the sensor; and installing the well foundation.

16. The method according to claim 15, wherein the method comprises monitoring the earth underneath the foundation during drilling using the sensor.

17. The method according to claim 15, wherein the well foundation is a suction anchor.

18. The method according to claim 15, wherein the method comprises detecting structural defects that could affect the structural integrity of the well foundation using the sensor.

19. The method according to claim 15, wherein the method comprises monitoring cement during installation of the subsea assembly.

* * * * *